US006012523A

United States Patent [19]

Campbell et al.

[11] Patent Number: 6,012,523

[45] Date of Patent: Jan. 11, 2000

[54] DOWNHOLE APPARATUS AND METHOD FOR EXPANDING A TUBING

[75] Inventors: Alasdair Campbell, Ellon; Paul David Metcalfe, Peterculter; Brian Scott, Dyce, all of United Kingdom

[73] Assignee: Petroline Wellsystems Limited, Scotland, United Kingdom

[21] Appl. No.: 09/077,116

[22] PCT Filed: Nov. 25, 1996

[86] PCT No.: PCT/GB96/02903

§ 371 Date: May 21, 1998

§ 102(e) Date: May 21, 1998

[87] PCT Pub. No.: WO97/20130

PCT Pub. Date: Jun. 5, 1997

[30] Foreign Application Priority Data

Nov. 24, 1995 [GB] United Kingdom ..... 9524109

[51] Int. Cl.[7] ..... E21B 29/00

[52] U.S. Cl. ..... 166/277; 166/207; 166/381

[58] Field of Search ..... 166/277, 381, 166/207, 242.1, 243, 212, 217

[56] References Cited

U.S. PATENT DOCUMENTS

| | | | |
|---|---|---|---|
| 1,494,128 | 5/1924 | Primrose | 166/207 |
| 3,191,677 | 6/1965 | Kinley . | |
| 3,437,159 | 4/1969 | Link et al. . | |
| 3,489,220 | 1/1970 | Kinley . | |
| 3,603,411 | 9/1971 | Link . | |
| 3,746,092 | 7/1973 | Land . | |
| 3,785,193 | 1/1974 | Kinley et al. | 166/277 |
| 5,197,553 | 3/1993 | Leturno . | |
| 5,785,120 | 7/1998 | Smalley et al. | 166/207 |

FOREIGN PATENT DOCUMENTS

| | | |
|---|---|---|
| 2 372 955 | 6/1978 | France . |
| 87/07322 | 12/1987 | WIPO . |
| 90/00216 | 1/1990 | WIPO . |
| 93/25800 | 12/1993 | WIPO . |

*Primary Examiner*—David Bagnell
*Assistant Examiner*—Chi H. Kang
*Attorney, Agent, or Firm*—Alston & Bird LLP

[57] ABSTRACT

Downhole apparatus is disclosed for use in expanding liner or tubing. The apparatus comprises a body for connection to a string and an expansion portion on the body. The expansion portion includes a plurality of radially movable parts for defining an outer surface thereof. The parts are initially arranged in an axially and circumferentially offset first configuration in which the parts may assume a smaller diameter first configuration. The apparatus is then run Into a borehole and through a length of expandable tubing. The parts are the moved radially outwardly and axially aligned such that the parts assume a larger diameter second configuration and define a substantially continuous outer circumference. The expansion portion is then pulled through the tubing to expand the tubing.

19 Claims, 4 Drawing Sheets

196
192
194d
210
214
194
194c
190
194b
211
194a
198
200
212
213
204
206
202
208

194
214
198
200
204
202
208

216
194c
200
212
202
220
218

DOWNHOLE APPARATUS AND METHOD FOR EXPANDING A TUBING

This invention relates to downhole apparatus and in particular to apparatus for use in expanding liner or tubing. The invention also relates to a method of expanding tubing.

WO-A-93/25800 (Shell Internationale Research) describes a method of completing an uncased section of a borehole in an underground oil-bearing formation. A liner provided with overlapping longitudinal slots is fixed at a predetermined position in the borehole. A tapered expansion mandrel or cone is then moved through the liner and expands the liner to a diameter larger than the cone maximum diameter. Ideally, the liner is expanded to such an extent that it contacts the bore wall. In one application, the slotted liner supports the borehole wall while permitting oil to flow from the formation into the bore. In other applications the liner is expanded into soft cement, and after the cement has set the bore is drilled out to the diameter of the expanded liner.

The liner may be run into the borehole with the cone already positioned at the liner upper or lower end, or the cone may be run in after the liner is fixed in the borehole. The latter operation requires provision of a cone with a smaller diameter configuration such that the cone may be passed through the bore casing and then expanded to a larger diameter configuration before being pulled or pushed through the liner. WO-A-93/25800 discloses one form of expandable cone, however the disclosed arrangement produces an expanded cone with a non-continuous circumference, resulting in non-circular expanded liner. This reduces the effective diameter and surface area of the liner, and results in the liner being spaced from the bore wall at a number of locations around the liner circumference; all of these features of the liner tend to reduce its effectiveness in terms of formation control and subsequent management.

It is among the objects of embodiments of the present invention to provide an expansion mandrel or cone which may assume a smaller diameter first configuration to allow running in through an unexpanded liner but which, in a second configuration, will maintain a larger diameter for expanding liner to a substantially circular form.

According to the present invention there is provided downhole apparatus for use in expanding tubing, the apparatus comprising a body for connection to a string and an expansion portion on the body which may be arranged to define a smaller diameter first configuration for running in and a larger diameter second configuration for expanding the tubing, the expansion portion including a plurality of radially movable parts for defining an outer surface thereof and which parts are axially and circumferentially offset for movement between the first and second configurations, and are axially alignable in the second configuration to define a substantially continuous outer circumference.

According to another aspect of the present invention there is provided a method of expanding tubing, the method comprising the steps of:

providing apparatus comprising a body for connection to a string and an expansion portion on the body, the expansion portion including a plurality of radially movable parts for defining an outer surface thereof;

arranging the parts in an axially offset first configuration in which the parts may assume a smaller diameter first configuration;

mounting the apparatus on a string;

running the apparatus into a borehole and through a length of expandable tubing;

circumferentially offsetting the parts;

moving the parts radially outwardly and axially aligning the parts whereby the parts assume a larger diameter second configuration to define a substantially continuous outer circumference; and then pulling the expansion portion through the tubing to expand the tubing.

The present invention thus avoids the disadvantages of existing proposals, in which the expansion mandrel or cone is made up of solely radially movable parts, to allow the parts to assume a smaller diameter configuration the parts must be circumferentially spaced when in the larger diameter configuration. In the present invention the ability to axially offset the parts obviates the need for such spacing.

Preferably, two sets of expansion portion parts are provided, each set comprising a plurality of circumferentially aligned parts with spaces therebetween to accommodate the other parts when each set is in the larger diameter second configuration. The parts may be configured to allow one set of parts to be radially extended to the second configuration and the sets then axially aligned before the other set is extended.

Preferably also, the apparatus includes means for moving the parts between the first and second configurations. The moving means may utilize mechanical forces transferred through the string but preferably utilise fluid pressure forces created by fluid pumped into or through the string and body. Thus, the body preferably defines a bore including a restriction to permit creation of a pressure force which may be utilised to drive a piston arrangement linked to the parts.

Preferably also, the apparatus includes means for retracting the parts from the second configuration to the first configuration. Most preferably, the retracting means is in the form of a biassing arrangement, conveniently a spring. Alternatively, the retracting means may be fluid pressure actuated and in such an apparatus fluid pressure may also be utilised to actuate means for moving the parts from the first to the second configuration. In one such apparatus valve means is provided to allow a fluid pressure force to move the parts in one direction from the first to the second configuration and then in the opposite direction from the second to the first configuration. The valve means may be actuated by, for example, application of an over-pressure to move a valve member from a first configuration to a second configuration. Such a valve means may be provided in conjunction with retracting means including a biassing arrangement, for use in the event of failure of the biassing arrangement.

The parts may take various forms including; pivotally mounted or flexible fingers, the free ends of which may be extended by axial movement of the fingers relative to appropriate cam surfaces; or radially moveable keys, which may be extended by axial movement of the keys relative to appropriate cam surfaces. Where the parts are in the form of flexible fingers, the parts may normally define a larger diameter in the first configuration, but be inwardly deflectable to the smaller diameter; in the second configuration the fingers are supported such that they are not deflectable.

According to a further aspect of the present invention there is provided downhole apparatus comprising a body for connection to a supporting string and a portion on the body which may be arranged to define a smaller diameter first configuration and a larger diameter second configuration, said portion including a plurality of radially movable parts which are axially and circumferentially offset in the first configuration, and are axially aligned in the second configuration.

According to a still further aspect of the present invention there is provided fluid pressure actuated downhole apparatus including: a body defining a bore; an annular actuating piston movable in the bore; and a valve piston movable relative to the actuating piston by application of bore fluid pressure, in a first position the valve piston permitting fluid pressure in the bore to be communicated to one side of the actuating piston and in a second position the valve piston permitting fluid pressure in the bore to be communicated to the other side of the actuating piston.

These and other aspects of the invention will now be described, by way of example, with reference to the accompanying drawings, in which:

FIG. 1 is a sectional view of one half of downhole apparatus for use in expanding slotted tubing in accordance with a first embodiment of the present invention, the apparatus being shown in a first configuration;

FIGS. 1*a* and 1*b* are sectional views on lines 1*a*—1*a* and 1*b*—1*b* of FIG. 1;

FIG. 2 corresponds to FIG. 1, but shows the apparatus in a second configuration;

FIG. 2*a* is an end view of FIG. 2;

FIG. 3 corresponds to FIG. 2, but shows the apparatus ready for movement from the second configuration to the first configuration under the influence of fluid pressure;

FIG. 4 corresponds to FIG. 3, but shows the apparatus after having been returned to the first configuration under the influence of fluid pressure;

FIG. 5 is a sectional view of downhole apparatus in accordance with a second embodiment of the present invention, the apparatus being shown in a first configuration;

FIG. 5*a* is a development of a portion of the apparatus of FIG. 5;

FIG. 6 corresponds to FIG. 5, but shows the apparatus in a second configuration;

FIG. 6*a* is a development of a portion of the apparatus of FIG. 6;

FIG. 7 is a sectional view of downhole apparatus in accordance with a third embodiment of the present invention, showing the apparatus in a first configuration;

FIG. 7*a* is a sectional view on line 7*a*—7*a* of FIG. 7;

FIG. 7*b* is a sectional view, corresponding to a view taken on line 7*b*—7*b* of FIG. 7 as the apparatus is passed through a restriction, and showing the apparatus in a first configuration;

FIG. 8 corresponds to FIG. 7, but shows the apparatus in a second configuration;

FIG. 8*a* is a sectional view on line 8*a*—8*a* of FIG. 8;

Figures 1, 1A, 1B, 2, 2A, 3, 4:
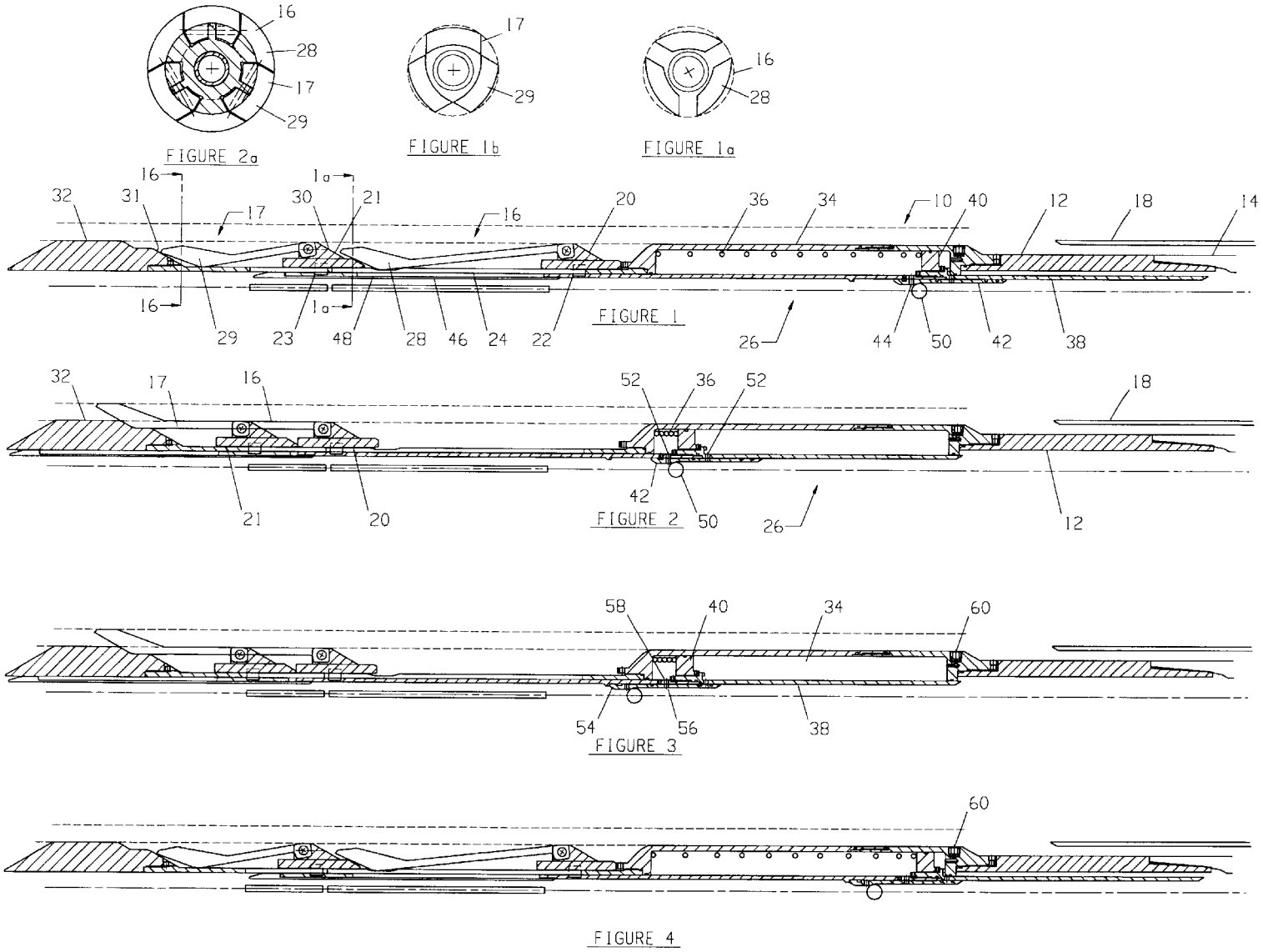

Reference is first made to FIG. 1 of the drawings, which illustrates downhole apparatus 10 for use in expanding slotted tubing in accordance with a first embodiment of the present invention. The apparatus comprises a tubular body 12 which is connected to the lower end of a drillstring 14 and carries an expansion portion including first and second sets 16, 17 of pivoting cone-forming fingers. In a first configuration, as illustrated in FIG. 1, the fingers 16, 17 define a diameter smaller than that of the slotted tubing 18 which the apparatus will be used to expand, such that the apparatus 10 may be run in through the tubing 18. As will be described, the fingers 16, 17 may thereafter be moved to a larger diameter second configuration (FIG. 2) such that the apparatus 10 may be pulled upwardly through the tubing 18 to expand the tubing into contact with the bore wall.

Each set of fingers 16, 17 is mounted on a respective trolley or carriage 20, 21 which is axially movable relative to the body 12, each carriage including load transfer keys 22, 23 extending through respective slots 24 in the body 12 and engaging a respective part of an actuating arrangement 26, further details of which will be described. In this example, each set 16, 17 includes three fingers, and each set is offset 60° from the other. FIGS. 1*a* and 1*b* of the drawings illustrate the finger free ends 28, 29 in the smaller diameter first configuration.

The upper face of each second carriage 21 defines a cam surface in the form of a ramp 30 such that when the first set of fingers 16 is moved downwardly relative to the carriage 21, the free ends of the fingers 28 ride up the ramp 30 to assume the larger diameter configuration. A similar effect is achieved for the second set of fingers 17 by a cam surface in the form of a ramp 31 defined by an enlarged lower body end portion 32.

The upper end of the body 12 defines a spring chamber 34 accommodating a coil spring 36 which normally biases the actuating arrangement 26 to a position in which the fingers 16, 17 are in the first configuration. The actuating arrangement 26 includes an inner sleeve 38, the upper end of which carries a collar 40 extending into the spring chamber 34, and which carries on its inner surface a sleeve 42 defining a restriction 44. The lower end of the inner sleeve 38 is connected to the carriage 20 via the load transfer keys 22 and also provides mounting for spring fingers 46 which protect a sleeve 48 linked to the second carriage 21 by the keys 23.

To move the fingers 16, 17 from the first configuration to the second configuration, a ball 50 is pumped down the drill string 14 from the surface and engages the restriction 44 effectively sealing the lower end of the string. Pumping down on the ball 50, in this example to a pressure of 77.3 $kg/cm^2$ (1100 psi), creates a pressure force which drives the actuating arrangement 26 downwardly. As the actuating arrangement begins to move the first carriage 20 is moved downwardly on the body 12, however the second carriage 21 does not move immediately. Thus, the first set of fingers 16 ride up onto the carriage 21 to assume the larger diameter second configuration. Continued movement of the actuating arrangement 26 brings the lower end of the first carriage 20 into contact with the upper end of the second carriage 21, and thus pushes the second carriage 21 downwardly such that the second set of fingers 17 ride up onto the body end portion 32. As will be noted from FIGS. 1*a*, 1*b* and 2*a*, the edges of the sets of fingers 16, 17 are configured such that the second set of fingers 17 may be expanded radially outwardly between the previously expanded first set of fingers 16.

With the fingers 16, 17 in the larger diameter second configuration, the apparatus 10 is lifted on the drill string through the tubing 18, forcing the tubing 18 to expand into contact with the bore wall. As is evident from FIG. 2*a*, the configuration of the free ends of the fingers is such that the expanded fingers define a substantially continuous circumference, such that the expanded tubing has a circular form.

In normal operation, following the expansion of the tubing 18, bleeding-off of pressure above the ball 50 will allow the spring 36 to lift the actuating arrangement 26 to retract the fingers 16, 17 to the smaller diameter first configuration, such that the apparatus 10 may be retrieved from the bore hole. However, if the spring 36 should fail, or a part of the apparatus 10 has been damaged or jams such that the spring 36 does not produce sufficient force to return the fingers 16, 17 to the first configuration, fluid pressure may be utilised to lift the fingers, as will now be described. As noted above, the restriction 44 which engages the ball 50 is defined by a sleeve 42 mounted on the inner sleeve 38. The sleeve 42 is held in place by shear pins 52 such that by application of an overpressure, in this example around 280 kg/cm$^2$ (4000 psi), the pins 52 will shear allowing the ball 50 and sleeve 42 to move downwardly to abut a shoulder 54 on the inner surface of the sleeve 38, as shown in FIG. 3. This movement brings a shear pin port 56 on the sleeve 42 into alignment with a shear pin port 58 in the sleeve 38. Thus, the fluid pressure from the string and apparatus bore can now be communicated into the spring chamber 34, below the collar 40. This drives the collar 40, and the rest of the actuating arrangement 26, upwardly such that the fingers 16, 17 are returned to the smaller diameter first configuration. To accommodate the displacement of fluid from the portion of the spring chamber 34 upwardly of the collar 40 a burst disc 60 is ruptured to allow fluid to flow from the chamber 34 into the bore hole annulus.

Figure 5:
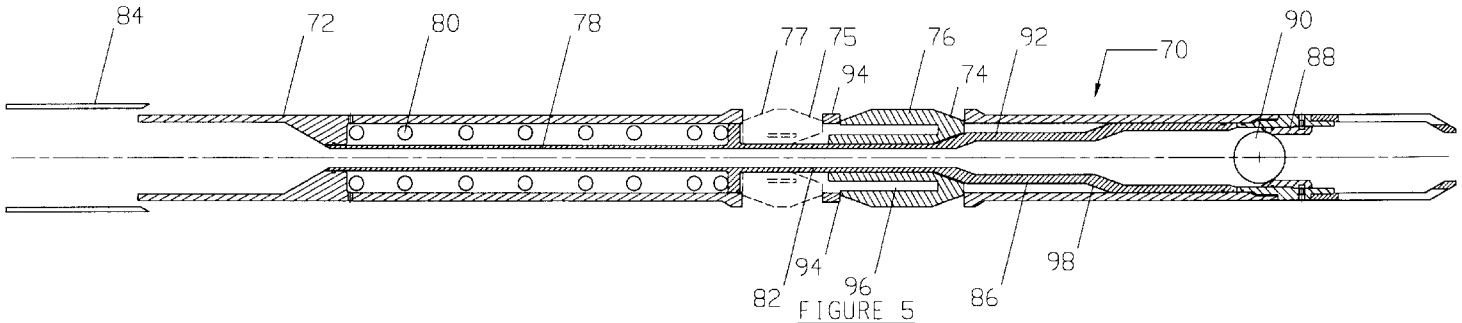
Figure 6:
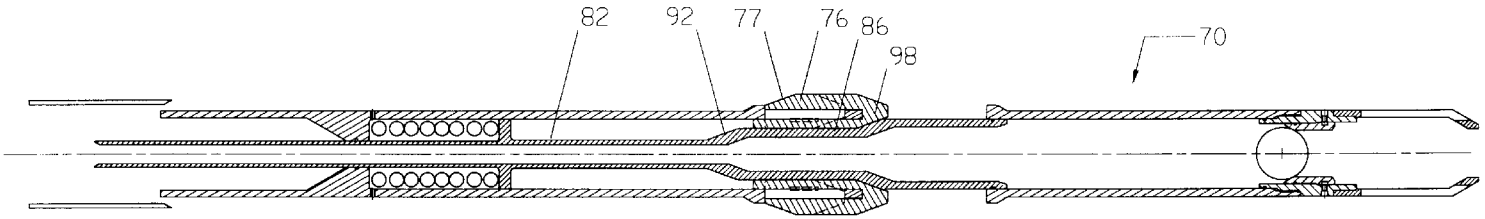

Reference is now made to FIGS. 5 and 6 of the drawings, which illustrate downhole apparatus 70 for use in expanding slotted tubing in accordance with a second embodiment of the present invention. It should be noted that in these drawings the "upper" end of the apparatus 70 is located to the left hand side of the drawings. The apparatus 70 comprises a tubular body 72 for connection to the lower end of a drill string (not shown) and defining two sets of windows 74, 75 accommodating respective sets of keys 76, 77. An axially movable sleeve 78 is mounted within the body 72 and is biassed towards a first position by a coil spring 80 which acts between the sleeve 78 and the body 72. The sleeve 78 defines an annular surface 82 and with the sleeve in its first position the surface 82 supports the keys 76, 77 in a smaller diameter first configuration, in which the apparatus 70 may be run through a length of slotted tubing 84. The sleeve 78 also defines a second surface 86 on which the keys 76, 77 may be supported in a larger diameter second configuration, as shown in FIG. 6 of the drawings.

The lower end of the body 72 includes a collar 88 defining a bore restriction which restricts downward movement of a ball 90 located within the bore. Thus, while running in, the ball 90 may be lifted from the collar 88 allowing well fluid to flow into the apparatus 70 and drill string. However, on pumping down through the drill string and apparatus 70, the ball 90 is pushed against the collar 88 to seal the bore such that the pressure within the bore rises. The sleeve 78 is configured such that a positive pressure differential between the body bore and the borehole annulus will tend to drive the sleeve 78 upwardly and thus move the keys 76, 77 from the first configuration to the second configuration, as will be described.

Figure 5A:
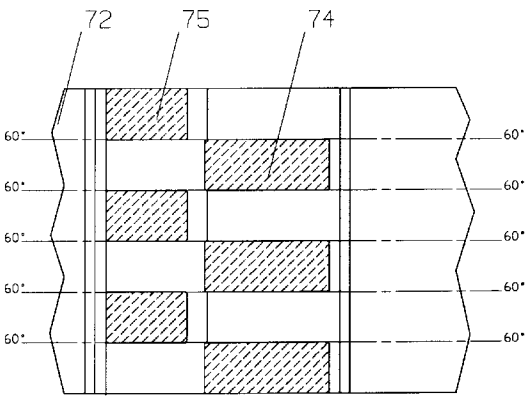
Figure 6A:
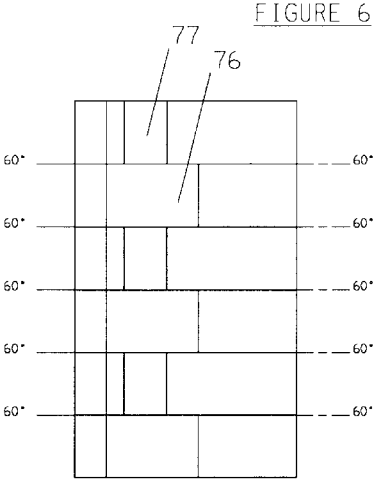

Each set of keys consists of three keys, and each set is circumferentially offset relative to the other by 60°. In the first configuration the keys 76, 77 are also axially offset, as may be seen in FIG. 5*a*. Accordingly, the windows 74, 75 are also circumferentially and axially offset, as may be seen in FIG. 5*a* of the drawings Upward movement of the sleeve 88 relative to the body 72 first lifts the first set of keys 76 radially outwardly as a ramp portion 92 between the surfaces 82, 86 engages the inner lower face of the keys 76. Initially, axial movement of the keys 76 is prevented by the window upper walls 94. However, as the keys 76 are moved outwardly each window wall 94 is brought into alignment with an axial slot 96 in the respective key, which allows the keys 76 to be moved into axial alignment with the second keys 77 on the ramp 98 at the lower end of the second surface 86 engaging the inner lower face of the keys 76. The second set of keys 77 is moved outwardly by the ramp 92 coming into contact with the inner lower face of the keys 77. Thus, at the end of the stroke of the sleeve 78, the keys 76, 77 are axially and circumferentially aligned, as illustrated in FIG. 6*a,* to define the larger second diameter, ready to be pulled through the tubing.

The keys 76, 77 are returned to the smaller diameter second configuration by bleeding off pressure from the bore, such that the spring 80 returns the sleeve 78 to its initial position, Attempting to pull through a restriction after pressure is bled off will cause the keys to collapse inwardly should the spring fail.

Figure 8:
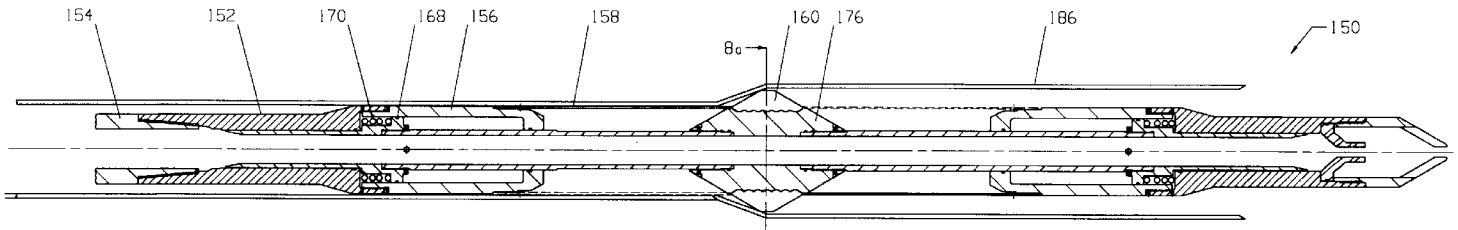
Figure 7:
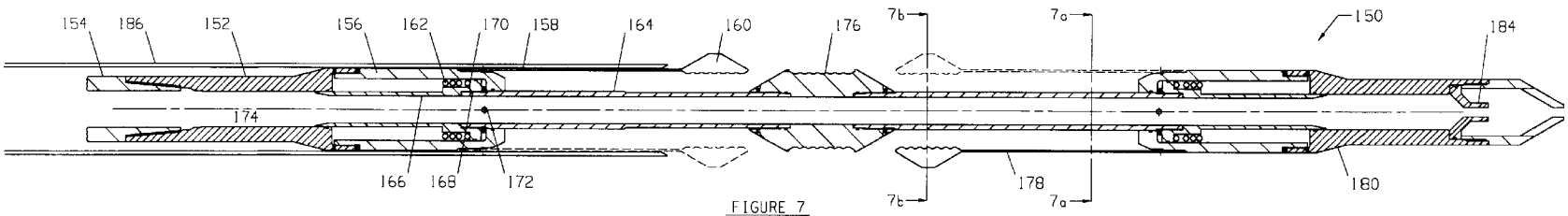

Reference is now made to FIGS. 7 and 8 of the drawings, which illustrate downhole apparatus 150 for use in expanding tubing in accordance with a third embodiment of the present invention. The apparatus 150 includes a tubular body 152 for connection to a drill string 154. Mounted to the lower end of the body 152 is a spring finger mounting assembly 156 from which three spring fingers 158 with enlarged free ends 160 extend axially downwards. The assembly 156 also defines an outer face of a spring and piston chamber 162, the inner face of the chamber 162 being defined by a piston and cam assembly 164 which is axially movable relative the spring finger mounting assembly 156. The assembly 164 includes a sleeve 166 carrying a piston 168 extending into the chamber 162, with a spring 170 abutting an upper face of the piston 168 and tending to move the assembly 164 downwardly relative to the assembly 156. Fluid ports 172 extend through the sleeve 166 to provide fluid communication between the apparatus bore 174 and the chamber 162, on the opposite side of the piston 168 from the spring 170.

Figure 7B:
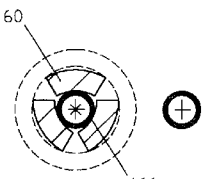
Figure 8A:
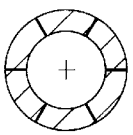
Figure 7A:
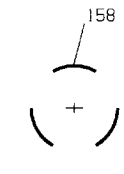

The assembly 164 also defines a cam portion 176 which, with the apparatus 150 in a first configuration, is spaced downwardly from the finger free ends 160, such that the ends 160 may be deflected inwardly as the apparatus 150 is run into a bore hole (see FIG. 7*b*).

The lower portion of the apparatus 150 is a mirror image of the upper portion, though the lower set of spring fingers 178 are offset by 60° to the upper fingers 158. Further, a lower body portion 180 mounted on the lower end of the piston and cam assembly 164 defines a restriction 184 in the bore 174.

For running in, the springs 170 tend to extend the apparatus 150 axially such that the spring finger free ends 160 are spaced from the cam portion 176, allowing the fingers to be deflected inwardly as the apparatus 150 is run in and is run through borehole restrictions such as the length of slotted tubing 186 which is to be expanded. After passing through the tubing 186, fluid is pumped through the string and the apparatus bore 174, and the restriction 184, to create a pressure differential across the sleeve 166. This results in the pistons 168 being moved in the spring and piston chambers 162 to compress the springs 170 and to move the spring finger free ends 160 onto the cam portion 176 (FIG. 8). With the fingers in this second configuration, the apparatus 150 may be lifted through the tubing 186 to expand the tubing, as illustrated in FIG. 8.

Once the tubing 186 has been extended, pressure is bled off from the bore 174 such that the springs 170 return the fingers 158 to the first configuration.

Figures 9, 10, 11:
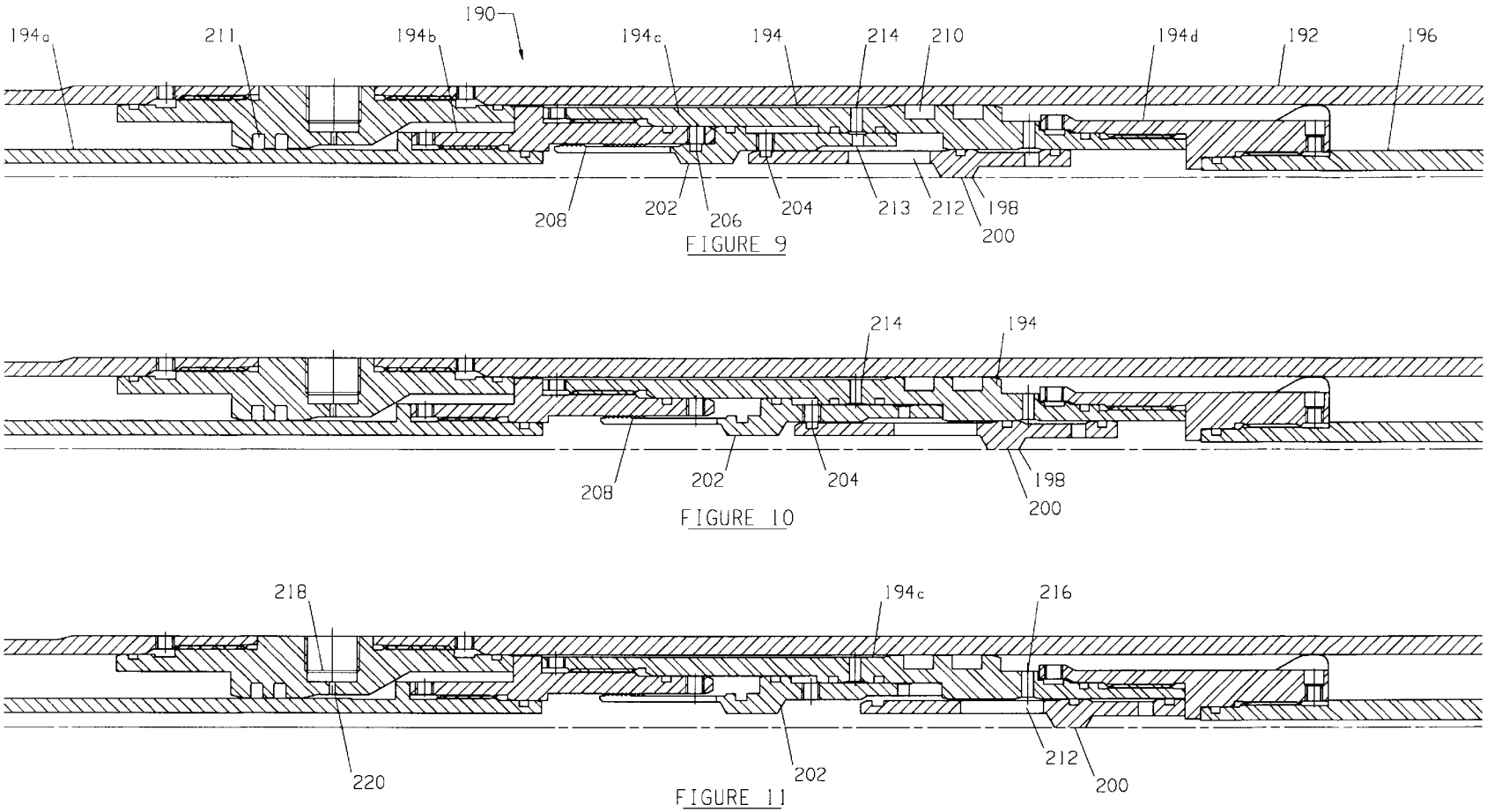
FIG. 9 is a sectional view of one half of an actuating arrangement in accordance with an aspect of the invention, the arrangement being shown in a first configuration.
FIG. 10 is a view corresponding to FIG. 10, and showing the actuating arrangement in an intermediate configuration.
FIG. 11 is a view corresponding to FIG. 9, and showing the actuating arrangement in a second configuration.

Reference is now made to FIGS. 9, 10 and 11 of the drawings, which illustrate details of an actuating arrangement 190 suitable for use with apparatus as described above.

In particular, the actuating arrangement 190 is primarily intended for use with a modified form of the apparatus 10.

The arrangement is provided within a tubular body 192 and includes an annular actuating piston 194, comprising a number of parts 194*a–d,* linked to an actuating rod 196 which transfers movement of the piston to the trolleys (not shown) on which the cone-forming fingers are mounted. A valve piston 198 is mounted within the actuating piston 194 and controls the movement of the actuating piston 194, and thus the formation of the expanding cone, as will be described. The valve piston 198 comprises a piston reverse sleeve 200 and a pressure retention sleeve 202, the sleeves 200, 202 being linked by a shear pin 204. The pressure retention sleeve 202 is linked to the actuating piston part 194*b* by a further shear pin 206, and a ratchet 208 is provided between the sleeve 202 and part 194*c,* the purpose of which will be described.

Seals are provided between the piston 194 and the body 192 at two locations 210, 211. With the valve piston 198 in a first configuration, as illustrated in FIG. 1, pressure from the surface (from the left hand side in the Figures) acts downwardly and creates a differential pressure acting over the area between the seals 210, 211, to move the piston 194 downwardly to form the expanding cone. The fluid pressure is communicated from the body bore to the piston 194 via ports 212, 213, 214 in the piston reverse sleeve 200, the pressure retention sleeve 202 and the actuating piston part 194*c,* respectively.

Once the cone has been formed, application of a first overpressure, for example $10\times10^6$ Pa (1500 psi), shears the pin 206 and permits movement of the valve piston 198, relative to the actuating piston 194, to an intermediate position (FIG. 10) in which the port 214 is closed by the pressure retention sleeve 202. If the pump at the surface providing the actuating pressure is then shut off, the piston 194 will remain in its downward position, and the cone remain formed, as the sleeve 202 is held in the intermediate position by the ratchet 208 and traps the pressurised fluid behind the piston 194. The sleeve 202 thus acts as a means for retaining pressurized fluid and locks the cone forming parts in the second configuration.

To retract the piston, and retract the cone-forming fingers to allow removal of the apparatus from the borehole, a further overpressure, for example $33\times10^6$ Pa (5000 psi) is applied, which shears the pin 204, allowing separation of the sleeves 200, 202 and opening another port 216 in the actuating piston part 194*c.* This permits the high pressure bore fluid to act on the reverse area or underside of the piston 194 and push the piston upwards. The fluid trapped between the seals 210, 211 escapes into the borehole annulus via a $33\times10^6$ Pa (5000 psi) burst disc 218, which defines a small area port 220 to provide controlled movement of the piston 194. The sleeves 200, 202 and the part 194*c* in conjunction with the ports 212, 213, 214, 216 thus collectively provide a valve means configurable for providing fluid communication with the piston 194 for moving the trolleys on which the cone forming fingers are mounted in one direction from the first to the second configuration and further being configurable for providing fluid communication with the opposite side of the piston 194 for moving the trolleys in the opposite direction from the second to the first configuration.

It will be apparent to those of skill in the art that the above-described embodiments are merely exemplary of the present invention, and that various modifications and improvements may be made thereto, without departing from the scope of the invention, for example the number of cone-forming fingers may be varied. The above embodiments are described as being mounted on drill pipe, though of course the apparatus may be mounted on any suitable supporting member or string, including coil tubing. It will also be clear that where terms such as "upper", "lower" and the like have been used, this has merely been to facilitate understanding, and the apparatus may of course be utilised in horizontal and inclined bore holes and in different orientations. Further, although the illustrated embodiments are described for use with slotted tubing, it will be clear that the apparatus of the invention may be utilised to expand other tubing forms and configurations, including sandscreens. Also, the actuating arrangement 190, although described with reference to a tubing expanding apparatus, may be utilised in any suitable fluid actuated downhole apparatus.

We claim:

1. Downhole apparatus including expandable tubing and expanding apparatus for use in expanding the tubing, the expanding apparatus comprising a body for connection to a string and an expansion portion on the body configurable to define a smaller diameter first configuration for running in and a larger diameter second configuration such that the expanding apparatus may be pulled through the tubing to radially expand the tubing, the expansion portion including a plurality of radially movable parts for defining an outer surface thereof and which parts are axially and circumferentially offset for movement between the first and second configurations, and are axially alignable in the second configuration to define a substantially continuous outer circumference.

2. The apparatus of claim 1, wherein at least two sets of radially movable parts are provided, each set comprising a plurality of circumferentially aligned radially movable parts with spaces therebetween to accommodate the parts of the other set when each set is in the larger diameter second configuration.

3. The apparatus of claim 2, wherein said parts are configurable to permit one set of parts to be radially extended and both sets of parts then axially aligned before the other set is extended.

4. The apparatus of claim 1 further comprising means for moving the parts between the first and second configurations.

5. The apparatus of claim 1 further comprising means for retracting the parts from the second configuration to the first configuration.

6. The apparatus of claim 1, wherein the parts are flexible fingers having axially deflectable free ends and means is provided for supporting said free ends in the second configuration.

7. The apparatus of claim 1, wherein the parts are radially moveable keys.

8. Downhole apparatus for use in expanding tubing, the apparatus comprising: a body for connection to a string; an expansion portion on the body configurable to define a smaller diameter first configuration for running in and a larger diameter second configuration for expanding the tubing, the expansion portion including a plurality of radially movable parts for defining an outer surface thereof and which parts are axially and circumferentially offset for movement between the first and second configurations, and are axially alignable in the second configuration to define a substantially continuous outer circumference; and means for moving the parts between the first and second configurations, wherein said moving means is fluid pressure actuated.

9. The apparatus of claim 8, wherein the body defines a bore including a restriction and a piston arrangement including an actuating piston is provided and linked to the parts, whereby a pressure differential may be created to drive the piston and move the parts from the first configuration to the second configuration.

10. The apparatus of claim 9, wherein the piston arrangement includes a piston chamber and means for sealing the chamber to retain pressurised fluid therein and lock the parts in the second configuration.

11. Downhole apparatus for use in expanding tubing, the apparatus comprising: a body for connection to a string; an expansion portion on the body configurable to define a smaller diameter first configuration for running in and a larger diameter second configuration for expanding the tubing, the expansion portion including a plurality of radially movable parts for defining an outer surface thereof and which parts are axially and circumferentially offset for movement between the first and second configurations, and are axially alignable in the second configuration to define a substantially continuous outer circumference; and means for retracting the parts from the second configuration to the first configuration, wherein the retracting means includes a biasing arrangement.

12. Downhole apparatus for use in expanding tubing, the apparatus comprising: a body for connection to a string; an expansion portion on the body configurable to define a smaller diameter first configuration for running in and a larger diameter second configuration for expanding the tubing, the expansion portion including a plurality of radially movable parts for defining an outer surface thereof and which parts are axially and circumferentially offset for movement between the first and second configurations, and are axially alignable in the second configuration to define a substantially continuous outer circumference; and means for retracting the parts from the second configuration to the first configuration, wherein the retracting means is fluid pressure actuated.

13. The apparatus of claim 12, further comprising fluid pressure actuated means for moving the parts from the first to the second configuration and valve means configurable for providing fluid communication with said means for moving the parts to allow movement of the parts in one direction from the first to the second configuration and further being configurable for providing fluid communication with said retracting means for allowing movement of the parts in the opposite direction from the second to the first configuration.

14. The apparatus of claim 13, wherein the valve means is a valve member controlling access to an actuating piston and in a first configuration permits fluid communication with one side of the piston to move the parts in one direction and in a second configuration permits fluid communication with the other side of the piston to move the parts in the opposite direction.

15. The apparatus of claim 14, wherein the valve member is movable in response to applied fluid pressure.

16. The apparatus of claim 15, wherein the actuating piston is located in a piston chamber and between the first and second configurations the valve member is movable to an intermediate configuration to seal the chamber and retain pressurised fluid therein to lock the parts in the second configuration.

17. Downhole apparatus for use in expanding tubing, the apparatus comprising a body for connection to a string and an expansion portion on the body configurable to define a smaller diameter first configuration for running in and a larger diameter second configuration for expanding the tubing, the expansion portion including a plurality of radially movable parts for defining an outer surface thereof and which parts are axially and circumferentially offset for movement between the first and second configurations, and are axially alignable in the second configuration to define a substantially continuous outer circumference, wherein the parts are pivotally mounted fingers.

18. The apparatus of claim 17, further comprising cam surfaces for extending the parts following axial movement of the parts relative to the cam surfaces.

19. A method of expanding tubing, the method comprising the steps of:

providing apparatus comprising a body for connection to a string and an expansion portion on the body, the expansion portion including a plurality of radially movable parts for defining an outer surface thereof;

arranging the parts in an axially offset first configuration in which the parts assume a smaller diameter first configuration;

mounting the apparatus on a string;

running the apparatus into a borehole and through a length of expandable tubing;

circumferentially offsetting the parts;

moving the parts radially outwardly and axially aligning the parts whereby the parts assume a larger diameter second configuration to define a substantially continuous outer circumference; and then pulling the expansion portion through the tubing to expand the tubing.

* * * * *